US008350712B2

(12) United States Patent
Chero et al.

(10) Patent No.: US 8,350,712 B2
(45) Date of Patent: Jan. 8, 2013

(54) EMERGENCY ALARM WITH A LIGHT TO PINPOINT THE LOCATION OF AN OCCUPANT

(76) Inventors: Gregory Chero, Babylon, NY (US); Brian Bolinger, Wakefield, RI (US)

( * ) Notice: Subject to any disclaimer, the term of this patent is extended or adjusted under 35 U.S.C. 154(b) by 581 days.

(21) Appl. No.: 12/606,614

(22) Filed: Oct. 27, 2009

(65) Prior Publication Data

US 2011/0095895 A1 Apr. 28, 2011

(51) Int. Cl.
*G08B 21/00* (2006.01)

(52) U.S. Cl. ..... 340/628; 340/573.1; 340/539.26

(58) Field of Classification Search ..... 340/573.1, 340/628–630, 578, 539.1, 539.27, 665–667, 340/539.26

See application file for complete search history.

(56) References Cited

U.S. PATENT DOCUMENTS

| | | | | |
|---|---|---|---|---|
| 4,996,517 | A | 2/1991 | Kringen et al. | |
| 5,493,271 | A | 2/1996 | Kobayashi et al. | |
| 5,780,798 | A * | 7/1998 | Hall-Jackson | 200/85 R |
| 5,880,672 | A | 3/1999 | Weaver | |
| 6,114,948 | A | 9/2000 | Astell | |
| 7,321,301 | B2 | 1/2008 | Spoltore et al. | |
| 7,333,129 | B2 | 2/2008 | Miller et al. | |
| 7,477,142 | B2 | 1/2009 | Albert et al. | |
| 7,566,830 | B2 | 7/2009 | Kjerrumgaard | |
| 2008/0218365 | A1 | 9/2008 | Kato | |
| 2009/0027225 | A1 * | 1/2009 | Farley | 340/825.37 |
| 2009/0051551 | A1 | 2/2009 | Pham et al. | |

* cited by examiner

*Primary Examiner* — Jeffery Hofsass

(57) ABSTRACT

The present invention relates to a safety apparatus for providing a visible signal to firefighters or other rescuers of occupants of a building that an occupant is in a particular location or room of the building. According to one embodiment of the invention, the safety apparatus may include an emergency detector, such as a smoke alarm or carbon monoxide alarm or the like responsive to an emergency condition, including a visible signaling device, and a detector responsive to the presence of an occupant for providing a signal to the visible signaling device when the safety device is activated by the emergency condition.

3 Claims, 4 Drawing Sheets

EMERGENCY ALARM WITH A LIGHT TO PINPOINT THE LOCATION OF AN OCCUPANT

BACKGROUND OF THE INVENTION

1. Field of the Invention

This invention relates to a safety apparatus to provide vital information regarding the location of a child, invalid, elderly person or other occupants. More particularly, the present invention relates to a safety alarm and visible indicator for providing pertinent information concerning the location of occupants to firefighters or other rescuers.

2. Description of the Prior Art

Every year thousands of lives are lost due to the outbreak of fires in private dwellings as well as business offices. In this regard, fire safety in the home is an important issue that has received much attention. Smoke detectors have been designed to inform occupants of the home that a fire has broken out. Other detectors, such as Carbon Monoxide detectors, have also been developed to alert occupants of a dangerous or potentially life threatening condition. As such, we may consider for ease of description or convenience, referring to all detectors as smoke detectors.

The smoke detector is typically a standalone device mounted to the ceiling that includes e.g., smoke detector means and alarm sounder means which sounds an audible alarm that alerts occupants of the emergency condition. Typically, but not always, a smoke detector has a built in light that illuminates the immediate area, when the alarm is sounded, in order to assist the occupants in their escape from the building. The smoke detector may be powered e.g., by DC 9V battery, or rechargeable battery or the buildings AC supply.

When it is not possible for an occupant to exit the building, the occupant must be rescued by rescue personnel such as local fire fighters. However, by the time fire fighters arrive at the incident, the dwelling or building is often filled with smoke and the fire fighters may have to make an informed guess as to which rooms of the dwelling are likely to be occupied. Unfortunately, it often happens that a fire fighter will make a valiant effort to gain access to a smoke filled room only to find that this room is unoccupied. The time taken to reach the empty room not only endangers the lives of the occupants in other parts of the building and the life of the fire fighter but also wastes precious time needed to locate those occupants in other parts of the building, generally in smoked filled rooms.

Accordingly, various approaches have been developed to signal the location of the occupants in the home to the rescue personnel. One such approach, "the tot finder" decal, was promoted by the fire services for a number of years. Parents were encouraged to attach the reflective stickers, the decals, to the windows of their children's rooms. In theory, during a response to a fire, the firefighter would be able to identify the room of a child and conduct a search of that room for the child.

As will be appreciated, the decal approach has a number of problems. First, during a fire or smoke or other emergency condition, especially at night, the decal may not be readily visible, especially if it is old and faded. Second, the window decal only indicated the location of the child's room, not that the child or anyone was in the room. Third, children do not always stay in the same room, especially as they grow and mature. Fourth, people have been known to forget to remove the decals from the windows when the child has changed rooms, moved out or the family has moved and another family has moved in. As is appreciated by those skilled in the art, these situations put firefighters or other rescue personnel at risk in their attempt to enter a room identified by the decal as a child's room, when no such child is in the room, as well as delaying the rescue and putting at risk occupants located elsewhere in the building.

Other apparatus have been developed to identify occupants of a building during an emergency, fire, smoke, carbon monoxide safety hazard condition, but all are either cumbersome or expensive.

SUMMARY OF THE INVENTION

The present invention relates to a safety apparatus for providing a signal to firefighters or other rescuers of occupants of a building that an occupant is in a particular location or room of the building. According to one embodiment of the invention, the safety apparatus may include a remote sensing unit, such, as an emergency detector, e.g., a smoke alarm or carbon monoxide alarm or the like responsive to an emergency condition, a signaling device detectable from the outside of the building to draw the attention of rescuers to a particular room of the building, and a detector responsive to the presence of an occupant for providing a signal to the signaling device when the safety device is activated by the emergency condition.

In another embodiment of the invention, the signaling device of the safety apparatus is a visible signaling device placed in the window of the room in which occupant detector is placed and connected to the remote sensing unit, e.g., smoke detector. The visible signaling device thereby may provide or emit a visible signal visible from the outside which by its signal draws the attention of the rescuers to that particular window thereby providing information to the rescuers that an occupant is in the room associated with the window in which the visible signaling device is located.

In another embodiment of the invention, the signaling device of the safety apparatus is an audible signaling device placed in the window of the room in which occupant detector is placed and connected to the smoke detector. The audible signaling device thereby may provide or emit an audible sound or statement, e.g., "child in this room" signal to be heard from the outside which provides information to the rescuers that an occupant is in the room associated with the window in which the signaling device is located.

In another embodiment of the invention, the signaling device of the safety apparatus is a visible and an audible signaling device placed in the window of the room in which occupant detector is placed and connected to the remote sensing unit. The audible device providing notification information to or drawing the attention of the rescuers to a particular room window and the visible signaling device may provide or emit a visible signal visible from the outside which provides specific information to the rescuers that an occupant is in the particular room associated with the window in which the signaling device is located.

In a further embodiment of the invention, the occupant detector is electrically coupled to a remote sensing unit, including an emergency detector, and the remote sensing unit is electrically coupled to the signaling device such that when the emergency detector detects the emergency condition and also receives a signal from the occupant detector then the signaling device is activated. It is understood by those skilled in the art that electrically coupled may mean hardwired electrical connections and wireless connections. It is further understood that in a wireless connection a transmitter is required to transmit the signal to the intended device and that intended device requires a receiver to receive the transmitted signal. The receiver may pass the received signal or may include additional circuitry to trigger another signal as is known in the art. A control unit in the remote sensing unit may receive the signals and produce a further signal to activate the signaling device.

In a further embodiment of the invention, the occupant detector is a sensor pad upon which an occupant sits or lies, e.g. a child or invalid in a bed, which transmits a signal in response to an occupant activating the sensor pad e.g., by sitting or lying thereon. The safety apparatus of this embodiment further includes a light, such as a strobe light which may be placed in the window of the room of the building, and a smoke detector for sensing a fire condition. The signal from the sensor pad arms provides one signal to the safety apparatus such that when the smoke detector sensors the emergency condition, e.g., a fire, and the smoke alarm produces its typical audible alarm sound to signal the occupants of the fire or smoke or other emergency condition, the safety apparatus may activate the light in the window. The light in the window provides the visible signal to the firefighters responding to the fire that an occupant is in the room associated with that particular window. Of course, the light may be a simple light, a strobe, an LED or, more specifically, a visible recognition device including lighted lettering such as, "Child Inside" or "Patient Inside" or the like.

In an additional embodiment of the invention, both the detector and the remote sensing unit of the safety apparatus are coupled to the signaling device such that the alarm of the remote sensing unit may function in response to the emergency condition, but the signaling device only functions when it receives signals from both the alarm and the detector. That is, if the occupant, e.g., patient, baby, or invalid, activates the detector, i.e., the detector is activated in response to the occupant, and the alarm is activated in response to the emergency condition, then the signaling device, preferably located in a window, is activated and emits a signal outside of the building. The signaling device thereby signals the firefighters that an occupant is in the room associated with that particular window. Conversely, if the detector does not sense an occupant, such that it does not produce a signal in response to an occupant, then even though the emergency detector detects an emergency condition and sounds its audible alarm in response to the emergency condition, the remote sensing unit does not produce a signal to activate the signaling device, i.e., neither a visible signal not an audible signal associated with the signaling device, preferably located in a window, is activated.

DETAILED DESCRIPTION OF THE DRAWINGS

Figure 1:
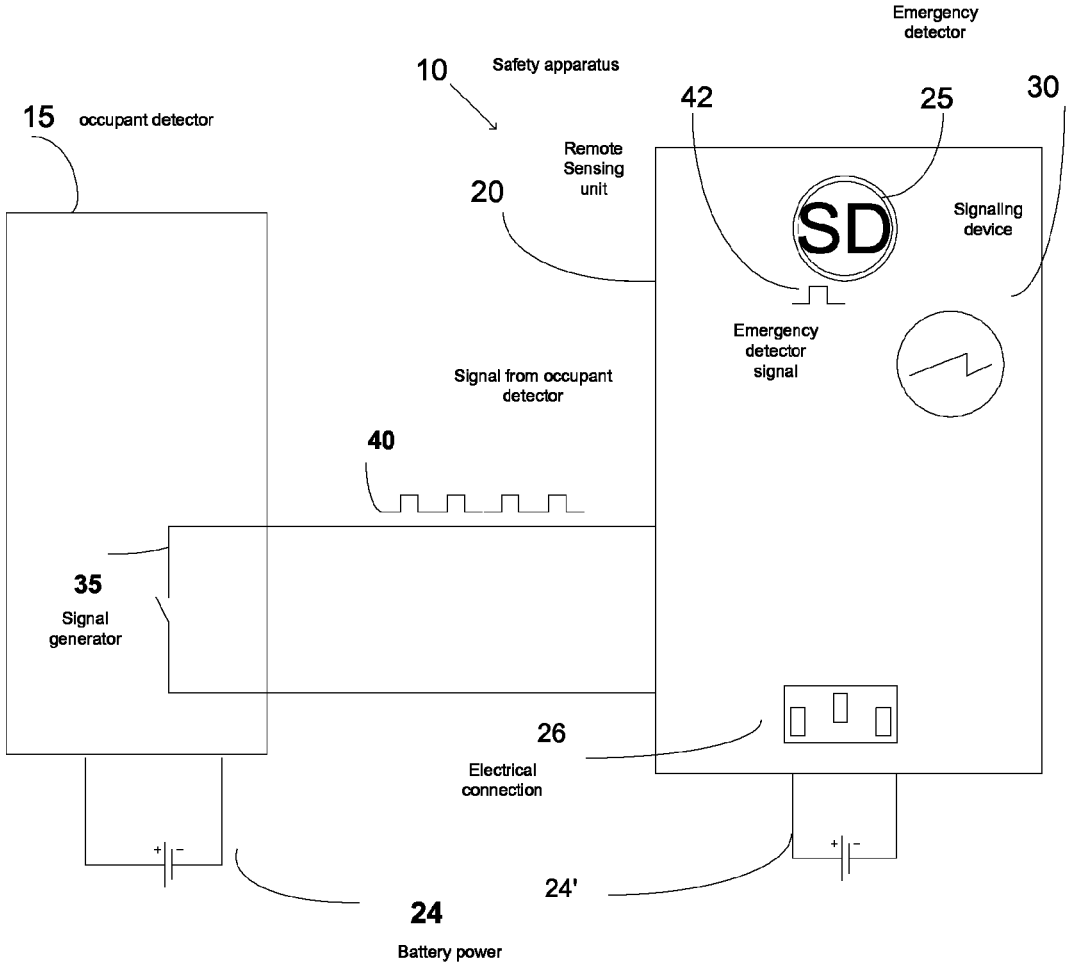
FIG. 1 is a schematic of one embodiment of the present invention.

FIG. 1 is a schematic of a safety apparatus 10 of the present invention for use in a building comprising a detector 15 connected to a remote sensing unit 20. The remote sensing unit 20 may include an emergency detector 25, e.g., a smoke detector, and may include a signaling device 30 as further described below. The detector 15 includes signal generating means 35, in the schematic of FIG. 1 this is shown as a switch, which is activated in response to the presence of an occupant of the building. The detector 15 may be a pressure or a force sensor pad using sensitive resistors or capacitive sensors and, more specifically, it may be a bed or chair sensor made by Tactex. The detector is generally battery powered 24 for safety considerations. The detector 15 triggers a signal, represented by pulses 40, in response to an occupant e.g., by the occupant sitting or lying on the detector 15. The detector 15 may be electrically connected by wires, hardwired, as shown in FIG. 1 or by wireless connection, as is known in the art and schematically shown in FIG. 2, to the remote sensing unit 20. The remote sensing unit 20, or more particularly, the emergency detector 25, which may include a smoke detector, operates in response to an emergency condition typically producing an audible alarm to alert the occupants of the building, but is not generally associated with alerting rescuers or firefighters. The emergency detector or smoke detector 25 produces a signal 42, which typically operates the audible alarm (not shown) of the emergency detector 25, and in the present invention is used to operate the signaling device 30, as further described below. When the emergency detector 25 is activated, e.g., by sensing a smoke condition, the signaling device 30 may or may not produce a signal to the outside of the building for alerting the rescuers. That is, the signaling device 30 activates in response to the emergency condition only when it receives the proper signal, i.e., the signaling device must receive the signal indicative of both the occupant in the room, signal 40, and the signal 42 indicative of an emergency condition. Both signal 40 and 42 may be sent to the signaling device 30 or a signal responsive to both signals 40 and 42 may be sent to the signaling device 30. In this way, if the detector 15 senses an occupant and the remote sensing unit 20 senses or is activated in response to an emergency condition, the safety apparatus produces a signal which is emitted outside of the building and which is indicative that an occupant is in the room of the signaling device 30. Otherwise, if the detector 15 does not sense the occupant, the remote sensing unit or more specifically, the smoke detector 25 may still produce an alarm in response to the emergency condition, but the signaling device 30 is not activated, as the remote sensing unit 20 has not received the signal 40 from the detector 15. There are a number of ways to activate the signaling device, as is well known in the art. For example, the signal 40 from the detector 15 may be presented to a component or control unit 60 (shown in FIG. 2) to combine with the signal 42 from the emergency detector 25 to activate the signaling device 30. The component 60 may also be logical component, e.g., an AND gate, which could be used to utilize the signal 40 as a switch to allow the signal 42 from the emergency detector to trigger the signaling device 30. It is obvious, that the signal 40 could be presented to the component 60 as the trigger and the signal 42 as the switch. In addition, it will be appreciated by those skilled in the art that the audible alarm of the remote sensing unit could be used as the signal 42 which with the signal 40 may be used to activate the signaling device when the detector signal 40 is received or is used as switch or as otherwise described above. Furthermore, as indicated above, the signaling device 30 may be an audible alarm, a visible signaling device or both and may be best located in a window of the room in which the detector 15 is located to provide an external visible reference to firefighters of the location of the occupant within the building, i.e., to alert rescuers that an occupant is in the room associated with the particular window having the signaling device. Thus, the signaling device 30 may be electrically connected to the remote sensing unit 20 but disposed some distance from the emergency detector 25 and, both the signaling device and the emergency detector may be located within the same room as the detector 15 or the emergency detector 25 may be located in a different room than the signaling device 30. Although an electrical connection 26 is schematically shown implemented in this embodiment of the remote sensing unit, it is recognized that battery power 24' may be more practical or desired or, as in the detector 15, for safety considerations be the primary source of power of the remote sensing unit.

Figure 2:
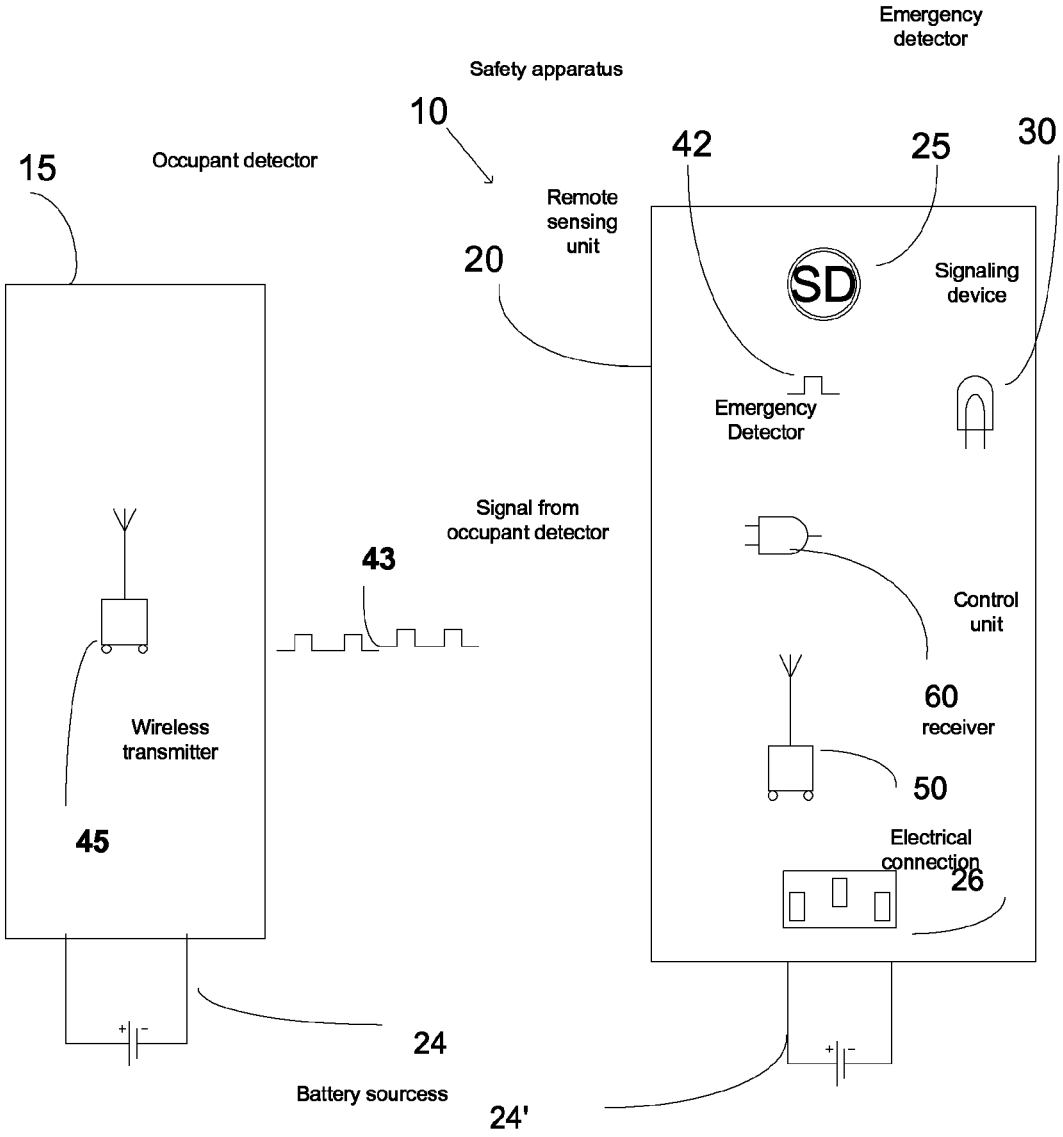
FIG. 2 is a schematic of a further embodiment of the invention.

FIG. 2 shows a schematic of the present invention described in connection with FIG. 1 with a wireless connection, represented by elements 45 & 50, as further described below, between the detector 15 and the remote sensing unit 20. As is known in the art, a wireless transmitter 45 associated with the detector 15 transmits the trigger signal from the detector 15, or, more specifically, either transmits that trigger signal or a pulse or a different signal representative of the trigger signal, all herein labeled 43 in FIG. 2, from the detector 15 to the remote sensing unit 20. In this way, the safety apparatus 10 avoids the need to run or install wires and eliminates the potential risks associated with wired systems. The remote sensing unit 20 includes a receiver 50, which may be a transceiver (as further described below) to use the signal 43 as described above in connection with signal 40 of FIG. 1 to activate the signaling device 30. The receiver 50 presents the signal 43, or a pulse or a different signal representative of signal 43 to component 60 which also receives the signal 42 from the emergency detector 25 to activate the signaling device 30, as previously described. In this event, if the control unit 60 receives a signal from the detector 15 via the transmitter 45 and receiver 50, and a signal from the emergency detector 25, then the component 60 triggers or otherwise activates the signaling device 30, which may be an audible alarm, safety light, strobe other visible signaling device (shown in FIG. 2 as a light) activated by the above elements of the remote sensing unit of this invention to emit a signal from the occupant's window to the outside and more specifically in connection with the light 30 shown in FIG. 2 to emit a visible signal to the potential rescuers, such as fire fighters.

Figure 3:
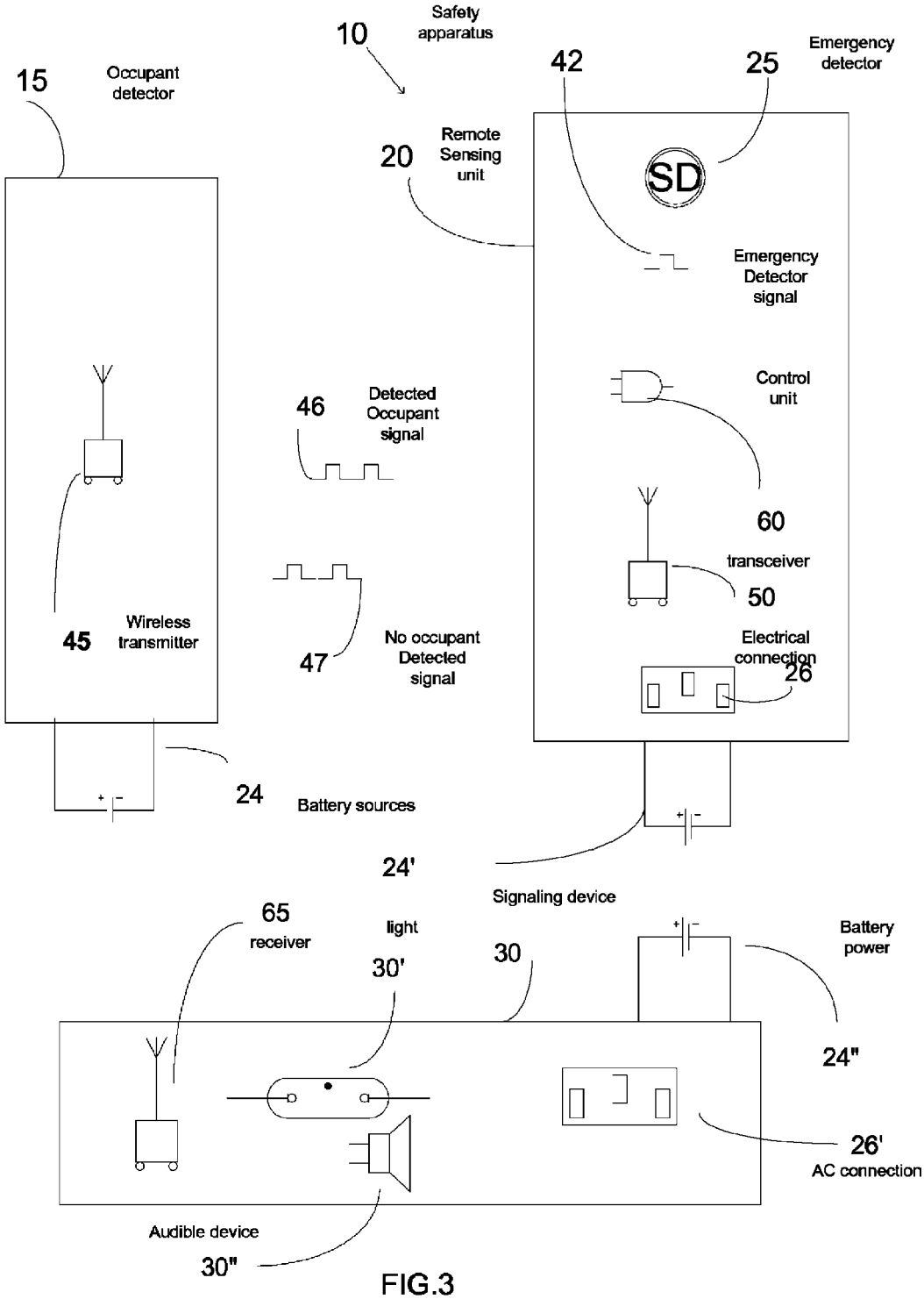
FIG. 3 is a schematic of a further embodiment of the invention.

FIG. 3 illustrates schematically a further embodiment of the invention in which the visible signaling device 30 is remotely disposed from and wirelessly connected to the remote sensing unit 20 and preferably disposed in the window of the occupant's room in which the detector 15 is located. In this embodiment the signal generating means 35 of the detector 15 may generate or trigger a signal in response to the occupant and a different signal when the occupant is not present, which may be used as further discussed below. The detector 15 includes the transmitter 45 to transmit signal 46 representative of a detected occupant as previously described. If the detector 15 transmits a signal indicative of no occupant, then the transmitter 45 may transmit signal 47 indicative of no occupant. The remote sensing unit 20 includes the emergency detector 25, transceiver 50 and component 60, which may be a control unit or microprocessor for receiving the signals 46 or 47 and 42 (from the detector 15 and the emergency detector 25) and for sending a further signal as further described herein. The visible signaling device 30 includes a receiver 65, light 30', which may be a strobe, LED, flashing light or other visible means to indicate that an occupant is in the room associated with the window in which the visible signaling device 30 is located and it may include an audible signaling device 30" shown here as a speaker. The signaling device 30 may include an AC connection 26' for connection to the building electrical system or a battery power system 24" or both. In the event of an emergency condition, the control unit 60 receives the signal from the emergency detector 25 and the transceiver 50. If the signal from the transceiver 50 is indicative of an occupant present in the room, the controller 60 produces a signal not shown which is transmitted by transceiver 50 and received by receiver 65 which is used to activate the visible signaling device 30, e.g., light 30', or audible device 30" or both thereby producing or emitting a visible signal, audible signalor both signals to alert firefighters that an occupant is in the associated room. In the event that the transceiver 50 receives signal 47 or as previously described does not receive a signal indicative that no occupant is present, the controller 60 does not produce a signal to be transmitted to receiver 65 to activate the light 70.

As will be appreciated, a second or mobile signaling device 30A (not shown) could be associated with the safety apparatus of this invention such that a control person, such as a parent could receive the signal emitted by the signaling device 30 and that parent could confirm to the firefighters that an occupant, e.g., a child was still in the room associated with signaling device 30 located within the window.

Figure 4:
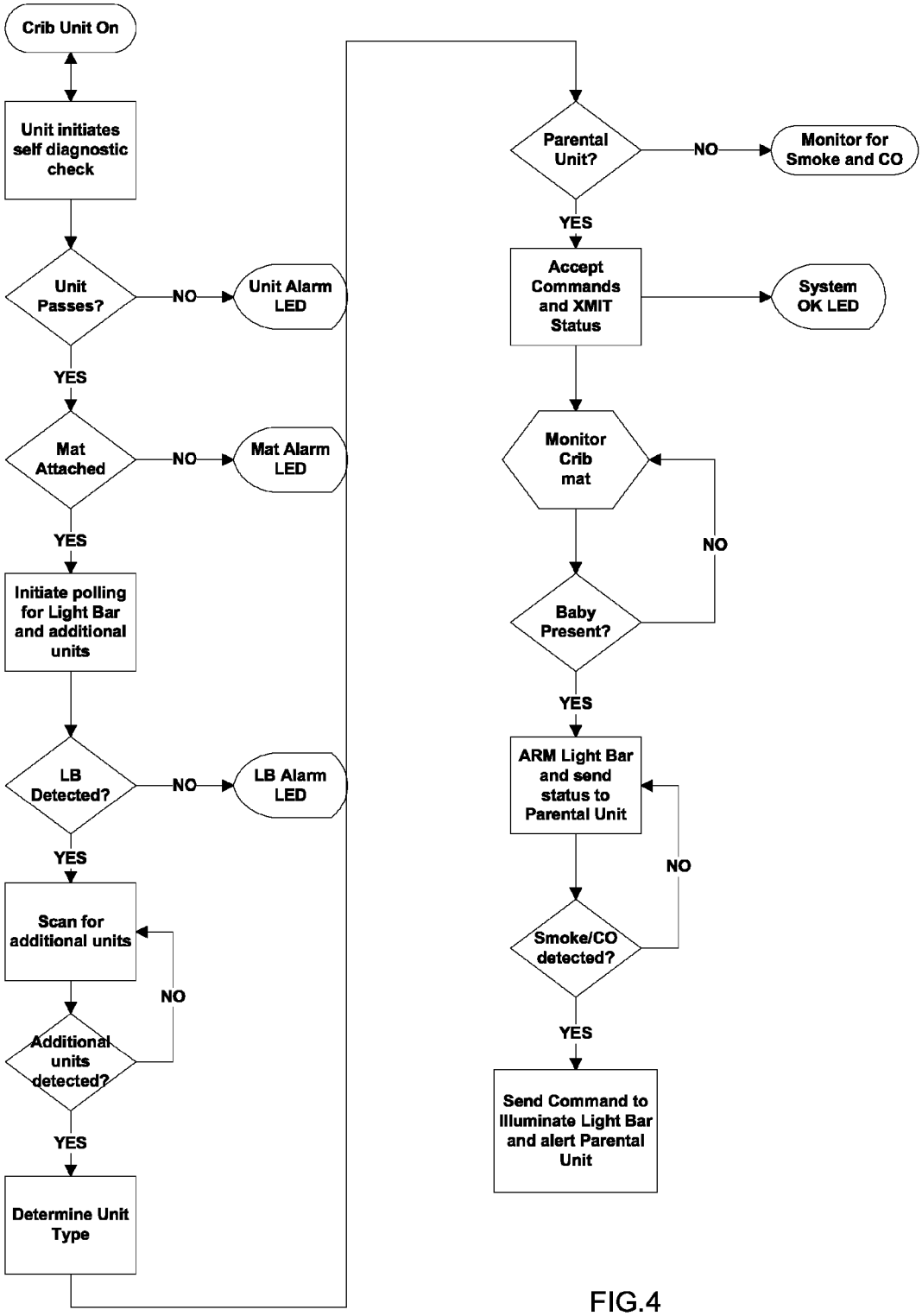
FIG. 4 is a flow chart according to an embodiment of the invention.

The logical steps that may be employed in such a safety apparatus are illustrated in FIG. 4.

While the foregoing description represents a preferred embodiment of the invention, many modifications and variations of the present invention are possible in light of the teachings herein. Thus, it is to be understood that, within the scope of the appended claims, the invention may be practiced otherwise than is specifically described above.

We claim:

1. An alarm comprising at least one smoke detector for generating a first signal in response to a smoke condition, a sensor pad responsive to the presence of a person for generating a second signal a first transmitter coupled to the sensor pad for transmitting a third signal when a person is detected by the sensor pad, a light separate from the smoke detector including a receiver, a transceiver for generating a fourth signal only in response to both the first and the third signal, the light being illuminated when the receiver receives the forth signal.

2. A alarm according to claim 1, wherein the sensor pad is a tactile sensing mat.

3. A alarm according to claim 1, wherein the sensor pad is a weight sensing mat.

* * * * *